US012007198B2

(12) United States Patent
Pernechele et al.

(10) Patent No.: US 12,007,198 B2
(45) Date of Patent: Jun. 11, 2024

(54) ROTATING PROTECTION DEVICE FOR A TUBULAR ROCKET LAUNCHER

(71) Applicant: AEREA S.p.A., Turate (IT)

(72) Inventors: Luca Andrea Pernechele, Sesto San Giovanni (IT); Stefano Rondoni, Arese (IT)

(73) Assignee: AEREA S.P.A., Turate (IT)

( * ) Notice: Subject to any disclaimer, the term of this patent is extended or adjusted under 35 U.S.C. 154(b) by 0 days.

(21) Appl. No.: 18/056,024

(22) Filed: Nov. 16, 2022

(65) Prior Publication Data

US 2023/0152058 A1 May 18, 2023

(30) Foreign Application Priority Data

Nov. 17, 2021 (IT) ..... 102021000029102

(51) Int. Cl.
*F41F 3/077* (2006.01)

(52) U.S. Cl.
CPC ..... *F41F 3/077* (2013.01)

(58) Field of Classification Search
CPC ..... F41F 3/077; F41F 3/04
See application file for complete search history.

(56) References Cited

U.S. PATENT DOCUMENTS

| | | | | |
|---|---|---|---|---|
| 3,167,278 | A * | 1/1965 | Roberge | B64D 1/22 89/1.816 |
| 3,456,552 | A * | 7/1969 | Nash | F41F 3/065 89/31 |
| 3,999,460 | A * | 12/1976 | Skliris | F41A 19/69 89/1.804 |
| 7,506,572 | B1 * | 3/2009 | Hombeck | F42B 14/06 89/31 |
| 2012/0055321 | A1 * | 3/2012 | Angeloff | F41F 3/077 89/1.51 |
| 2017/0205193 | A1 * | 7/2017 | Teetzel | F41F 3/077 |

FOREIGN PATENT DOCUMENTS

| | | |
|---|---|---|
| CN | 111002646 A | 4/2020 |
| EP | 1714105 B1 | 1/2012 |
| IT | 201900025273 A1 | 6/2021 |

OTHER PUBLICATIONS

Italian Search Report and Written Opinion dated Jun. 24, 2022, 10 pp.

* cited by examiner

*Primary Examiner* — Derrick R Morgan
(74) *Attorney, Agent, or Firm* — Heslin Rothenberg Farley & Mesiti P.C.; Victor A. Cardona, Esq.

(57) ABSTRACT

A protection device for a rocket launcher includes a cover with a triplet of openings arranged in angularly equidistant positions so as to allow a passage of the rockets housed in two alternating triplets of rocket housings. An actuation means is designed to rotate the cover between a first position in which the triplet of openings is aligned with the first triplet of openings and a second position in which the triplet of openings is aligned with the second triplet of housings.

6 Claims, 8 Drawing Sheets

ROTATING PROTECTION DEVICE FOR A TUBULAR ROCKET LAUNCHER

CROSS REFERENCE TO RELATED APPLICATIONS

This application claims priority from Italian Patent Application No. 102021000029102 filed on Nov. 17, 2021, the entire disclosure of which is incorporated herein by reference.

FIELD OF THE INVENTION

The present invention generally relates to protection devices for the bow section of a rocket launcher and, more particularly, it relates to a device for protecting the head of rockets contained in a rocket launcher provided with six launch tubes.

STATE OF THE PRIOR ART

A rocket launcher device typically comprises a cylindrical casing containing a plurality of tubular housings for rockets, so-called launch tubes, arranged in angularly equally spaced positions with respect to the axis of the rocket launcher, and the protection means usually comprise a circular cover applied, in a coaxially rotatable fashion, to an end of the casing for the front closure of the launch tubes.

The rocket launcher, or so-called multi-tube rocket launchers, are devices designed to be installed on fixed platforms, aircraft or land vehicles, and they are designed to launch, usually one at a time, a plurality of rockets contained in launch tubes.

As novel "smart" rockets provided with laser guide means have become increasingly common, there has arisen the need to appropriately protect the homing head of such rockets from the plume of the rocket launched previously. In particular, the applicant observed that in a multi-tube rocket launcher of the "standard" type, that is provided with six angularly equidistant rocket housings, it is sufficient to protect only the head of the rockets adjacent to the launched one.

Document WO2012030637A1 discloses a rotary cover mounted on the front face of a missile launching device which consists of a circular plate provided with a single opening so as to allow the passage of a missile. The cover is driven in rotation by an electric motor with predefined angular pitches so as to align the only opening with the missile which should be launched whenever required.

When using rotary protection covers thus made there arises the problem of aligning and keeping the opening aligned with the rocket to be launched as precisely as possible. As a matter of fact, it is clear that even a minimum error when aligning the opening with the rocket to be launched, for example due to involuntary rotations of the cover caused by the vibrations of the vehicle on which the rocket launcher is installed, entails the risk of interference, between the missile being launched and the cover, which could even lead to disastrous results.

Similar drawbacks are observed in the case of protection covers of the rocket launching devices described in documents WO2010/065639A1, WO2005/078378A1 and GB2176881B.

A common characteristic of such documents actually lies in providing for protection devices of the heads of a plurality of rockets which are provided with a single opening which should be, whenever required, rotated by an angular pitch corresponding to the subsequent rocket to be launched, entailing the criticalities relating both to not guaranteeing the actual and precise opening-rocket alignment in all different rotations of the cover, as well as to not guaranteeing the maintenance of such alignment for the entire period of time required to launch the rocket.

EP1714105 B1 describes a rocket launcher which includes a protection cover with a single opening for the passage of rockets. An electric motor drives the cover in rotation between one of the safety positions in which the opening is arranged at a respective one of the closed portions of the rocket launcher and one of the loaded positions in which the opening is arranged at one of the rocket housings. To launch all rockets with a configuration of the cover thus made, the only opening should be rotated, by the angular pitch required upon the alignment thereof with one of the plurality of the rockets to be launched. Such solution does not guarantee the actual and precise opening-rocket alignment when launching all rockets.

In a variant of EP1714105 B1 the rocket launcher comprises a plurality of cylindrical housings suitable to remain empty which are arranged alternately to the housings suitable to receive the rockets, and the cover comprises a number of openings equal to the number of housings containing the rockets. Such openings are, whenever required, aligned either with the rockets to be launched in the loaded configuration of the rocket launcher, or with the empty housings in the safety configuration of the rocket launcher. A design of the cover thus made entails the opening or the simultaneous closing of all openings of the rockets. Therefore, it is clear that, when launching, the rockets adjacent to the rocket to be launched are also aligned with the respective openings and this does not allow to appropriately protect the head thereof from the plumes of the adjacent rocket during when launching.

IT 201900025273 owned by the applicant in question, relates to a rocket launching device comprising a rotatable protection cover also provided with a single eccentric opening. The cover is driven in rotation by angular pitches corresponding to the positions of the launch tubes so as to align the single opening with the launch tube of the rocket to be launched. With this configuration of the cover there arises the need to provide for supplementary safety systems for locking the cover, whenever required, in the opening-rocket alignment position to guarantee the actual maintenance of such alignment for the entire period of time required to launch the rocket. This entails the drawbacks of increasing both the weight as well as costs for the production and maintenance of the rocket launcher.

SUMMARY OF THE INVENTION

The object of the present invention is to overcome the aforementioned drawback.

A further object of the invention is to provide a rocket launching device provided with greater reliability with respect to the devices currently available.

With the aim attaining such objects, the invention relates to a protection device for a rocket launcher provided with two alternating triplets of rocket housings arranged in angularly equidistant positions with respect to the axis of the rocket launcher, whose primary characteristic lies in the fact that the protection device comprises a cover which includes a triplet of openings arranged in angularly equidistant positions so as to allow the passage of rockets housed in one or the other of the alternating triplets of housings, and in that the actuating means of the cover are designed to rotate the cover between a first position, in which the triplet of openings is aligned with the first triplet of housings, and a second position, in which the triplet of openings is aligned with the second triplet of housings.

A configuration thus made of the protection device allows to make all rockets contained in the rocket launcher available for launching through a single rotation of the cover. Therefore, this allows to simplify the mechanical and electronic devices required to rotate the cover which, having only two operating positions, does not require to be rotated, whenever required, by the angular pitch required to align a single opening with a plurality of rockets to be launched.

In a preferred embodiment of the invention, the cover comprises a triplet of safety portions, each provided with a weakening line designed to break the respective safety portion without fragments. Such safety portions are angularly interposed between the openings of the cover.

This allows to guarantee a risk-free use of the rocket launcher, even in the remote chance that the rocket be launched without the correct alignment of the openings of the cover with the rockets to be launched.

In an embodiment, the safety portions are made of a composite material having a continuous epoxy matrix surrounded by a perimeter line comprising a part in which the fibres are mechanically interrupted so to allow the breaking of the corresponding safety portion, and a part in which the fibres are continuous so as to allow the broken safety portion to remain connected to the cover so as not to produce fragments.

In this manner, in the case of an accidental launch of a rocket not aligned with the opening of the cover, the safety portion intercepted by the rocket can be broken along the interruption lines of the fibres and it can rotate around the part consisting of the continuous fibres remaining.

In a preferred embodiment of the invention, the actuation means comprise an electronic control unit, an electric motor controlled by the control unit, a drive shaft for the cover, and a manual release device including releasable coupling means between the motor and the drive shaft.

In this manner, an operator may manually rotate the cover to load, unload or carry out maintenance operations on the rockets.

According to a further aspect of the invention, the protection device comprises a safety device designed to verify the correct alignment of the openings with the triplet of the launch tubes of the rockets to be launched. Such device includes at least one movable pressing tooth carried by the cover and at least one fixed switch for each of the aforementioned two alignment positions between openings of the cover and launch tubes.

In a preferred embodiment of the invention, the protection device comprises a mechanical limit switch designed to ensure the correct opening-rocket alignment in the aforementioned two cover positions. Such limit switches include at least one movable abutment element carried by the cover and at least one fixed abutment element for each of the two alignment positions between the openings of the cover and the launch tubes of the two triplets.

In a preferred embodiment of the invention, the protection device comprises a permanent magnet brake controlled by the electronic control unit for braking the rotation of the cover in the two alignment positions between the openings and launch tubes.

BRIEF DESCRIPTION OF THE DRAWINGS

Further characteristics of the invention will be apparent from the following detailed description, with reference to the attached drawings, provided purely by way of non-limiting example, wherein.

DETAILED DESCRIPTION OF THE INVENTION

Figure 1:
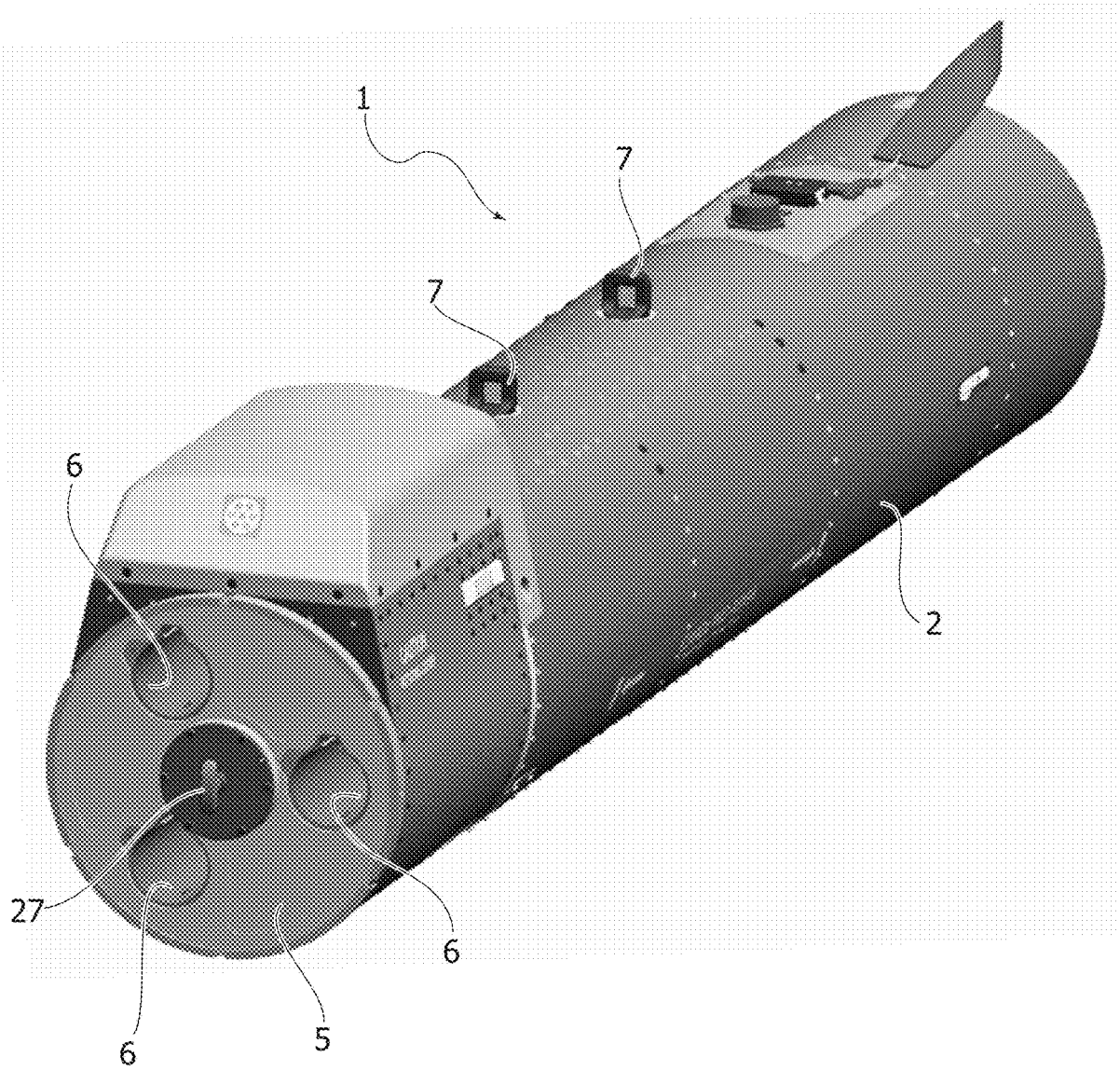
FIG. 1 is a schematic perspective view of a rocket launcher provided with the protection device according to the invention.
Figure 2:
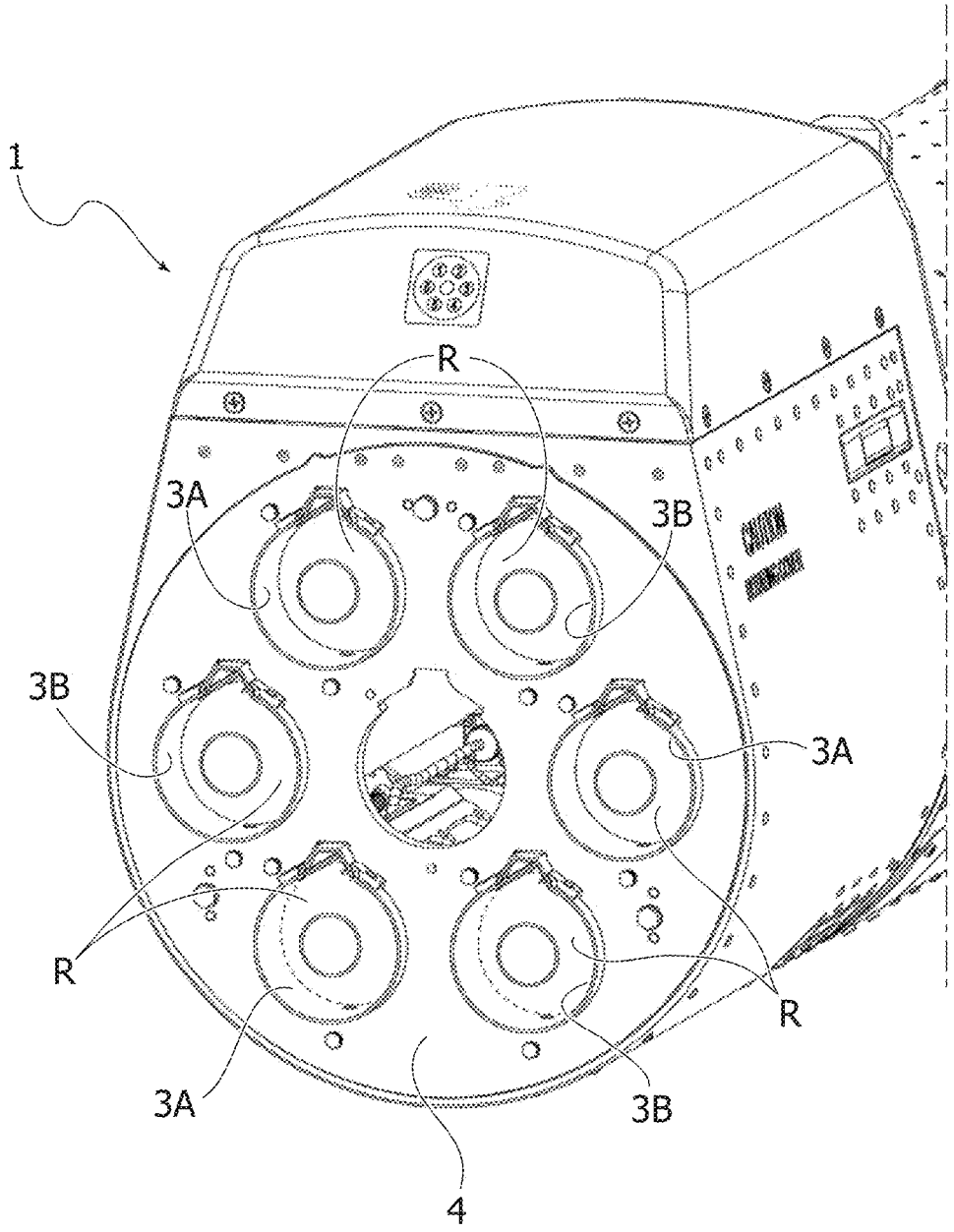
FIG. 2 is a partial schematic perspective view of a rocket launcher provided with six rocket housings.

Initially with reference to FIGS. 1 and 2, indicated with 1 is a generic rocket launching device comprising a cylindrical casing 2 within which there are provided for, in angularly equidistant positions with respect to the axis of the rocket launcher 1, six tubular housings 3A, 3B, so-called launch tubes, each designed to contain a rocket R. For the sake of descriptive clarity the housings are divided into two different triplets the housings of the first triplet 3A are alternating with the of the second triplet 3B.

The rocket launching device 1 is of the generally conventional type, therefore only the essential components and the components expressly referred to in the invention will be described.

On the front end face 4 of the rocket launching device 1, that is the launch face of the rockets R, there is applied—in a coaxially rotatable fashion—a circular cover 5 provided with a triplet of openings 6 arranged in angularly equidistant positions so as to allow the passage of the rockets R housed in one of the two alternating triplets of housings 3A or 3B.

In FIG. 1 the cover 5 is shown in the first operating position thereof, wherein the openings 6 are aligned with the first triplet of the launch tubes 3A, allowing to launch the respective rockets R, while the cover 5 closes the second triplet of pipes 3B, protecting the head of the rockets R housed therein.

The cover 5 may rotate, as mentioned hereinafter, between the aforementioned first position and a second position in which the triplet of openings 6 is aligned with the second triplet of housings 3B.

On the casing 2 there is provided for a pair of hooks 7 for installing the rocket launching device 1 on a means of transport not shown.

Figure 3:
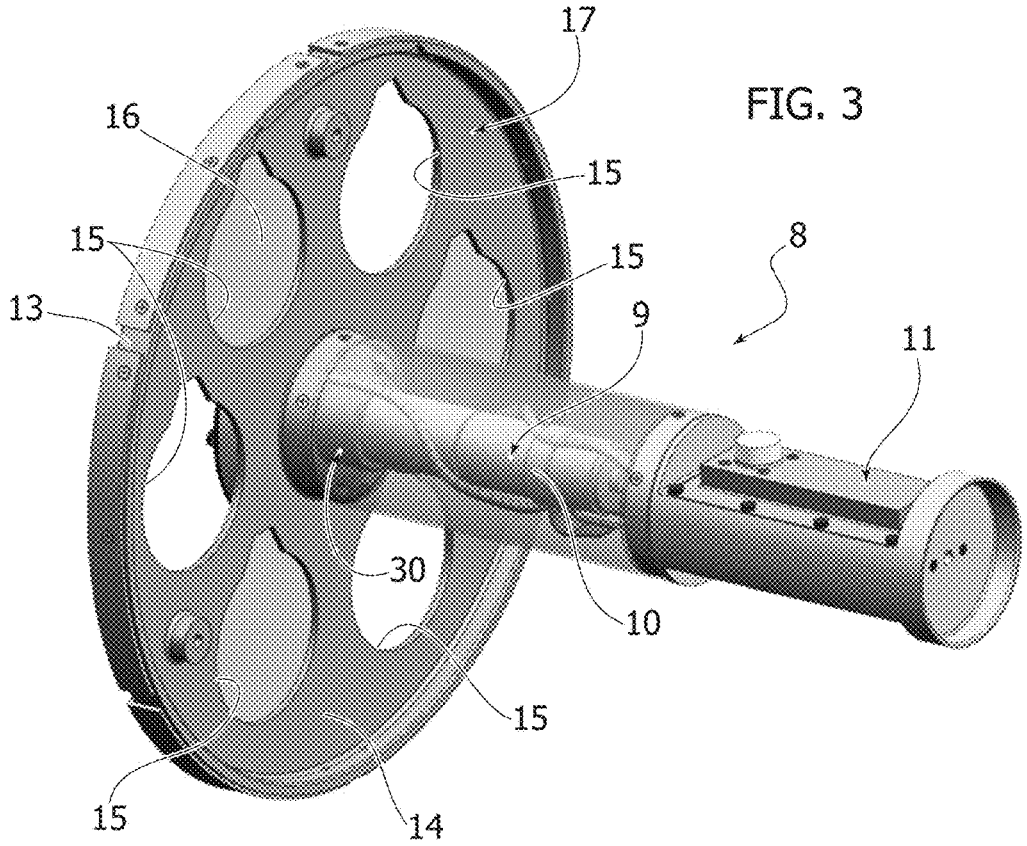
FIGS. 3 and 4 are perspective views—in larger scale—of the protection device for a rocket launcher according to the invention.
Figure 4:
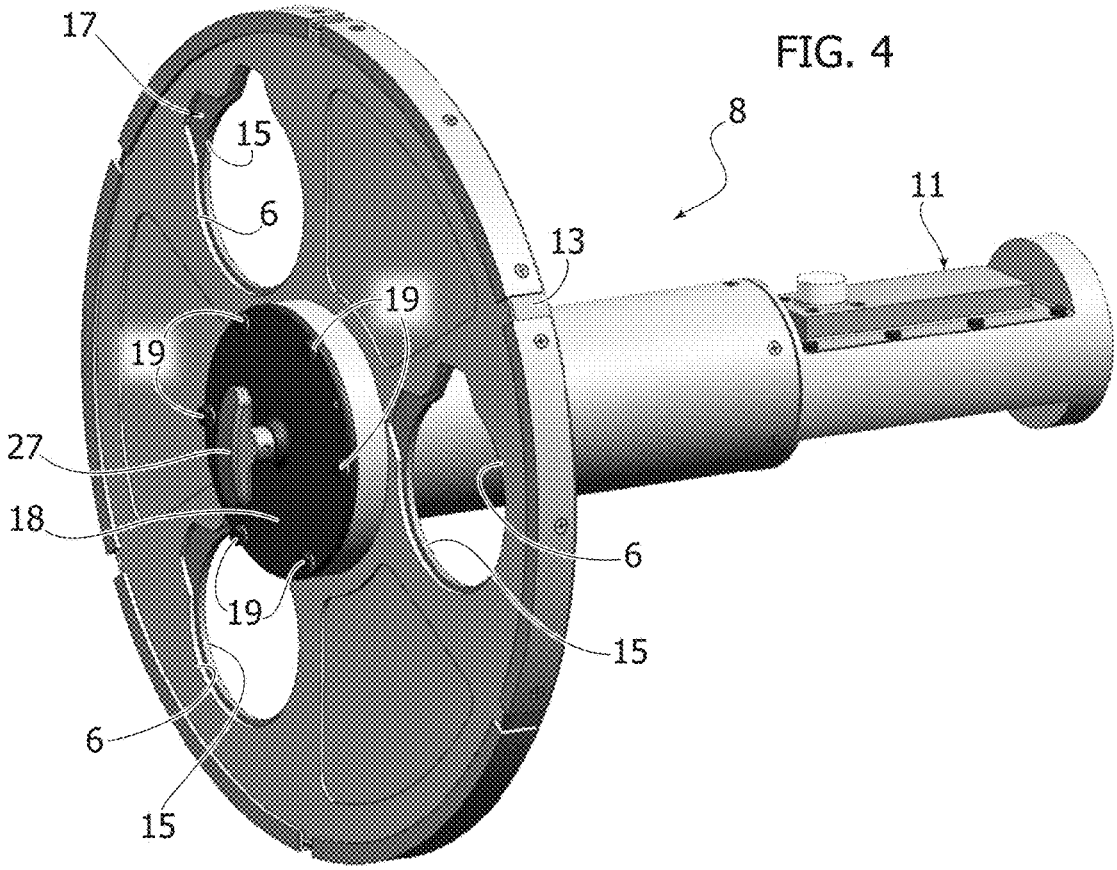

FIGS. 3 and 4 show the protection device 8 according to the invention provided with a cover 5 and means for the actuation and locking thereof 8, which will be described hereinafter.

With reference to FIG. 3, the inner surface 16 of the cover 5 faces a flange 17 which can be coupled integrally joined with face 4 of the rocket launcher. Such flange 17 has a perimeter edge 13 which surrounds the cover 5 and a circular crown surface 14, concentric with the cover 5, provided with a number of openings 15 equal to that of the launch tubes 3A, 3B of the rocket launcher 1. The openings 15 are arranged in angularly equidistant positions so that, when the flange 17 is installed on the rocket launcher 1, each opening 15 is aligned with a respective launch tube 3A, 3B.

Generally indicated with 9 are means for driving the cover in rotation, in this embodiment comprising a "brushless" motor 10 provided with a drive shaft 22 and controlled by an electronic control unit contained in an appropriate container 11.

Figure 5:
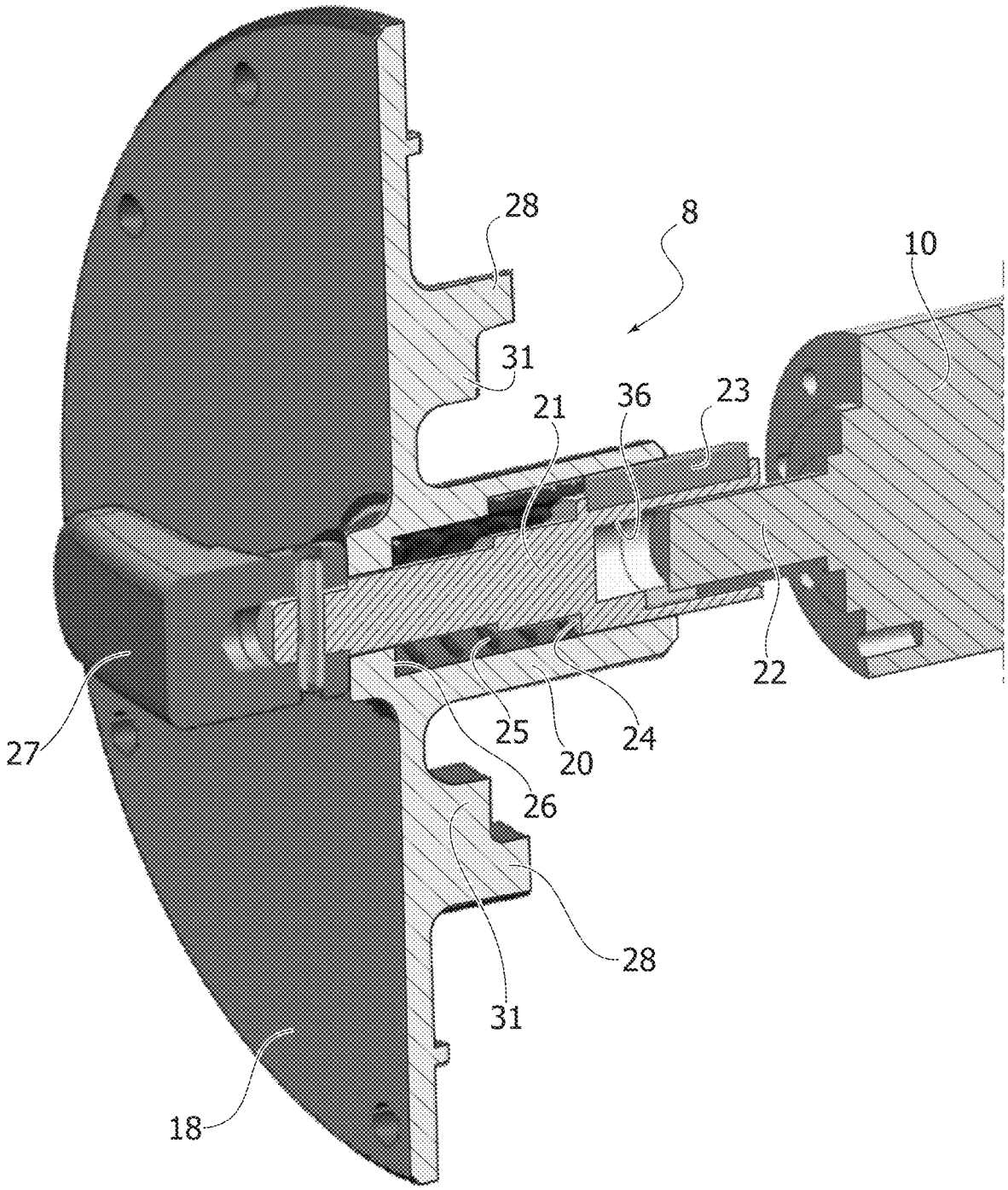
FIGS. 5 and 6 are sectional perspective views of a part of the protection device according to the invention into two different use configurations.
Figure 6:
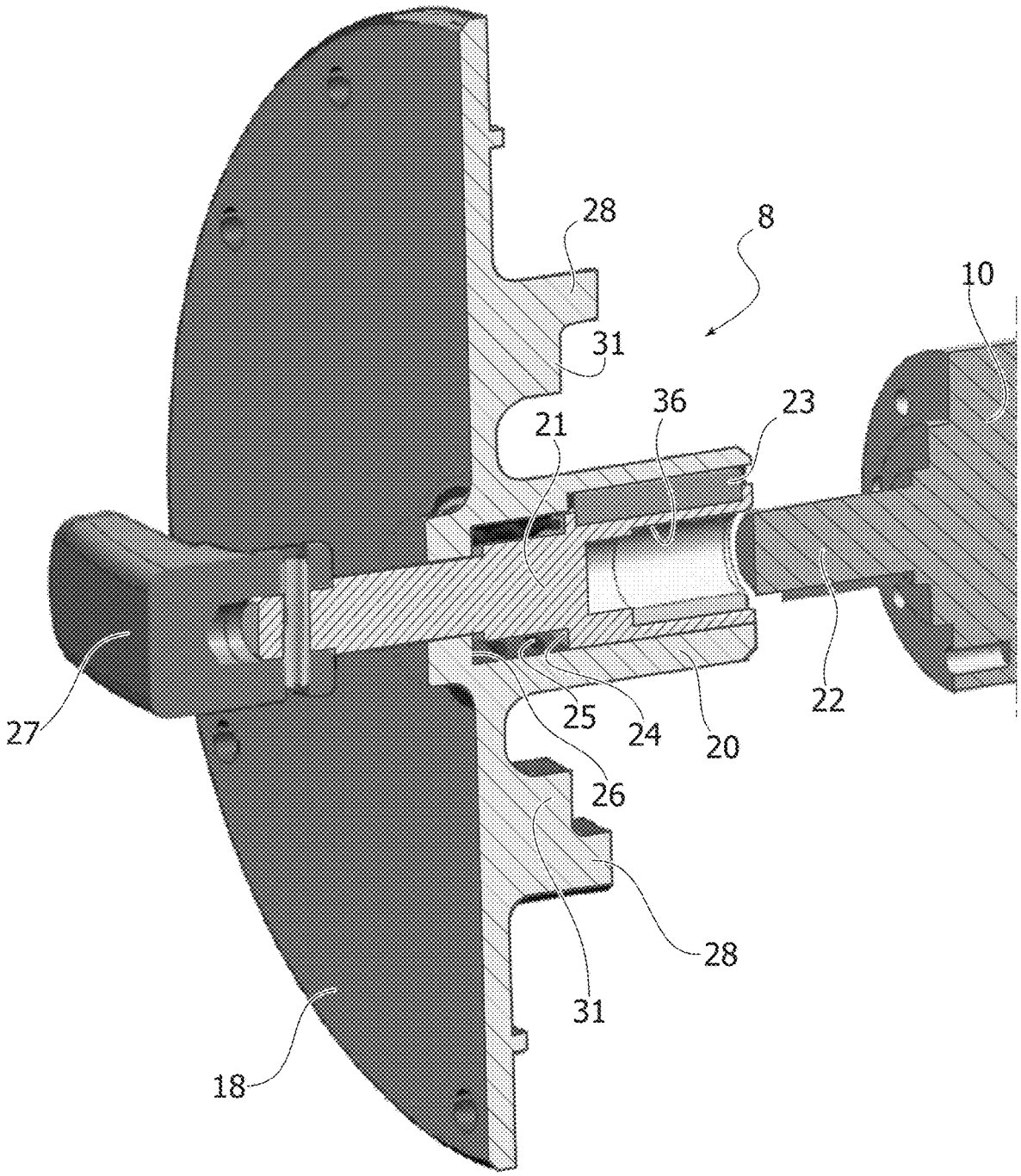

Now, with reference to FIGS. 5 and 6, such means for actuating the cover 9 further comprise a support for the disc-shaped cover 18 fixed to the cover 5 through a plurality of tangential bolts 19 and from which there axially protrudes a hollow cylindrical portion 20 inside which a drive shaft 21 is coaxially slidable to transmit the rotation motion of the shaft 22 of the motor 10 to the disc-shaped support 18 and therefore to the cover 5.

The drive shaft 21 has, in an end thereof, a seat 36 suitable to be releasably coupled with the drive shaft 22, and—in the opposite end thereof—a handle 27, protruding from the disc-shaped support 18, for de-coupling the seat 36 from the shaft 22 as mentioned hereinafter.

Furthermore, the drive shaft 21 has a median portion provided with a protruding tangential end 24 abutting against an end of a counteracting spring 25 coaxial to the hollow cylindrical portion 20 and having the opposite end abutting against an internal central portion 26 of the support cover 18.

With reference to FIG. 6, manually actuating the handle 27 allows to axially translate the drive shaft 21—against the force of the spring 25 de-coupling the seat 36—to the drive shaft 22, allowing an operator to manually rotate the cover 5 to load, unload or carry out maintenance on the rockets R. Upon releasing the handle 27, the force of the spring 25 pushes the drive shaft 21 so that the seat 36 is once again coupled with the drive shaft 22 restoring the mechanical connection between the motor 10 and the cover 5, as observable in FIG. 5.

According to an embodiment of the invention not shown in the figures, at the handle 27 there is provided for a coloured warning strip visible should the drive shaft 21 not be correctly coupled with the drive shaft 22.

Figure 7:
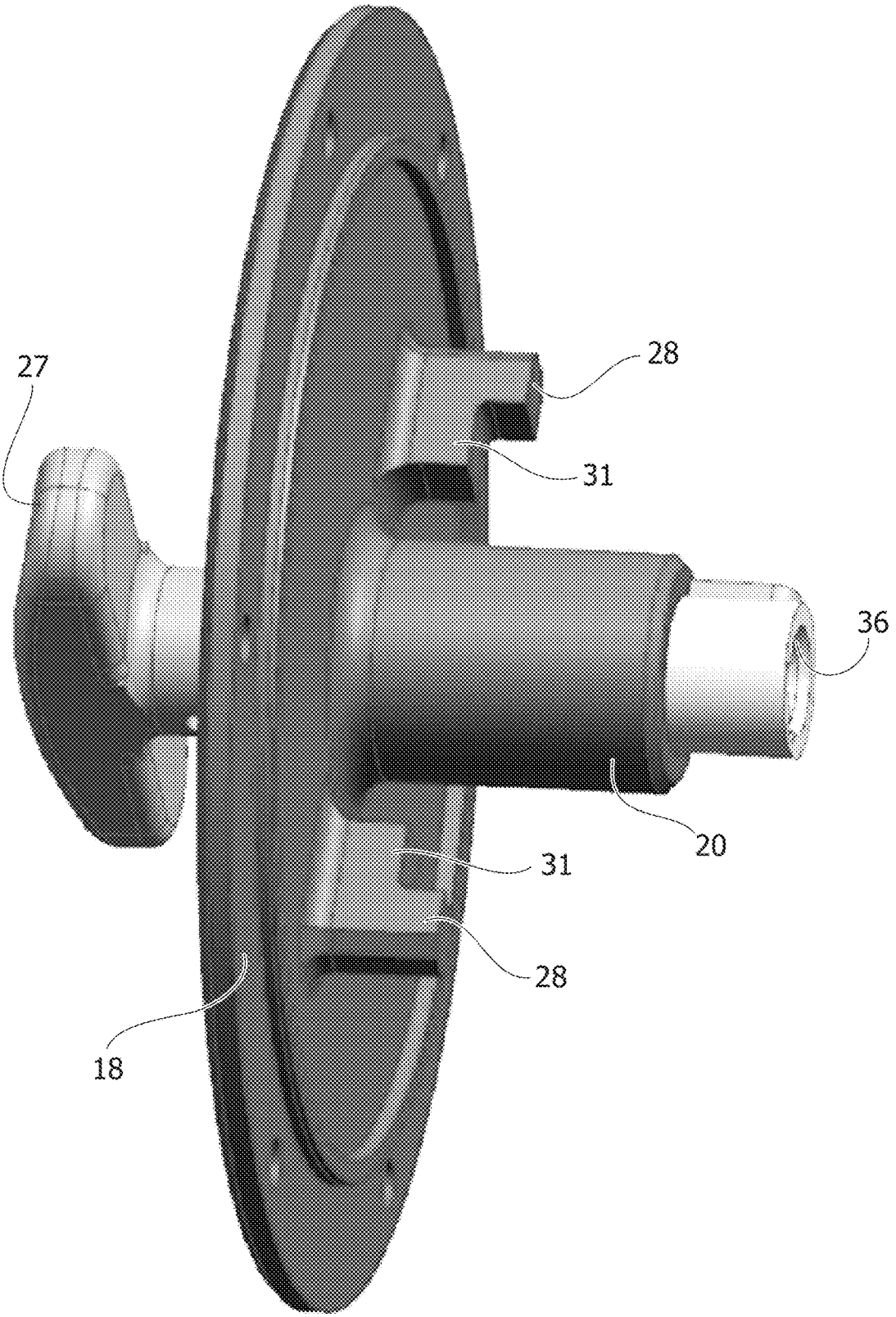
FIG. 7 is a perspective view of a part of the protection device according to the invention.
Figure 8:
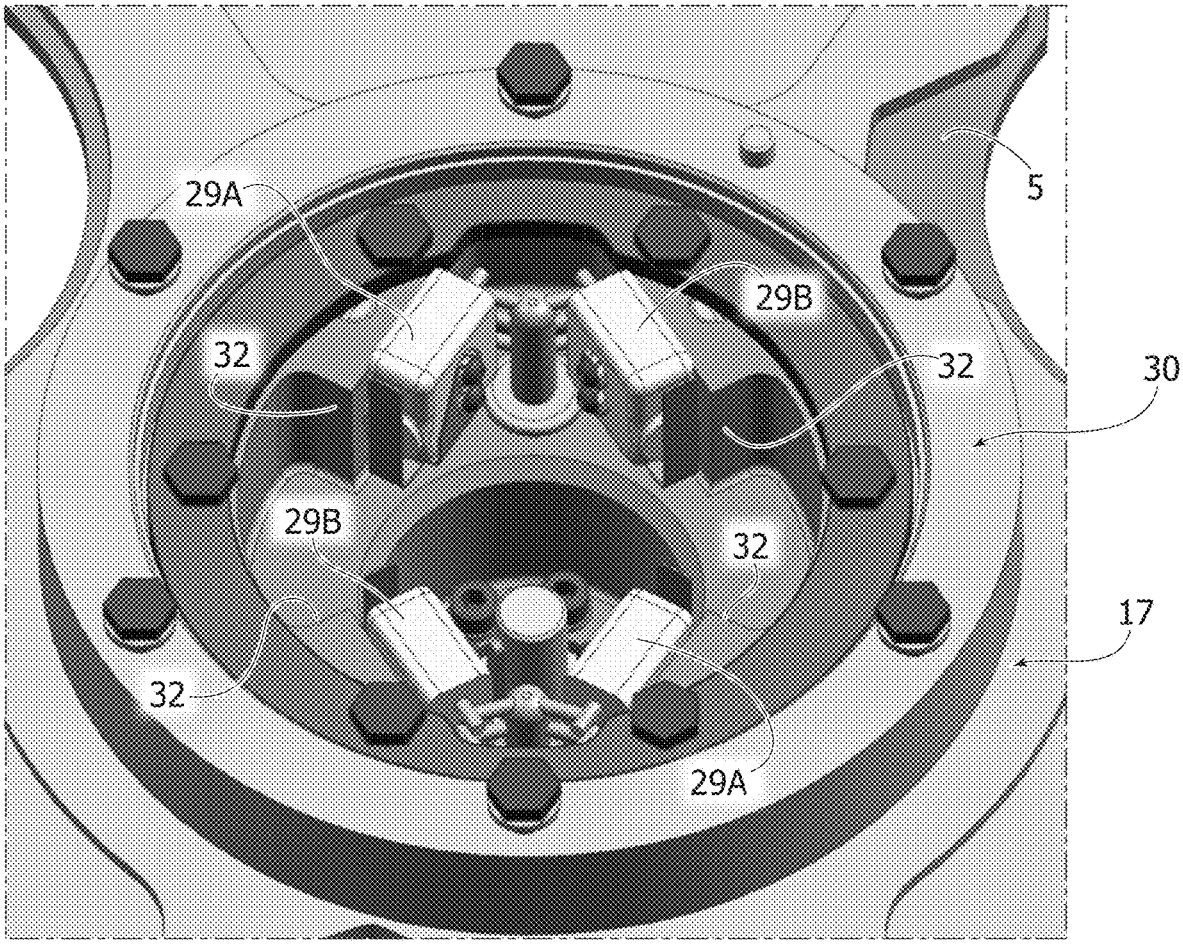
FIG. 8 shows—in perspective view—some internal details of the protection device according to the invention.

FIGS. 7,8 show a safety device designed to verify the correct alignment triplet of openings 6 with one of the two triplets 3A, 3B of the launch tubes of the rockets R to be launched. Such safety device includes a pair of pressing teeth 31 arranged in a mirror-like fashion protruding from a median portion of the disc-shaped support 18 and two pairs of switches 29A, 29B arranged in a mirror-like fashion fixed within a thickened central portion 30 of the flange 17.

The arrangement of the two pairs of switches 29A-29B and of the pair of pressing teeth 31 is such that, when the cover 5 is in the aforementioned first position for aligning the openings 6 with the first triplet of housings 3A, the pressing teeth 31 press the first pair of switches 29A sending the signal—to the electronic control unit—that the cover 5 is in the correct aligning corresponding to the first use position thereof. When the cover 5 is actuated in the second position for aligning the openings 6 with the second triplet of housings 3B, the pressing teeth 31 moved by the support 18 press the second pair of switches 29B signalling—to the electronic control unit—the correct alignment of the openings 6 and of the housings of the second triplet 3B.

The protection device 8 according to the invention further comprises a pair of mechanical limit switches which include a pair of movable abutment elements 28 adjacent to the pressing teeth 31 carried by the support 18 of the cover 5, and a pair of fixed abutment elements 32 adjacent to the switches 29A, 29B. Such mechanical limit switches 28, 32 guarantee that the cover 5 does not exceed the rotation required to align the openings 6 with the respective two triplets of launch tubes 3A, 3B, and they offer a contact surface on which the system is to be preloaded to reduce clearances and vibrations avoiding the potential occurrence of involuntary rotations of the cover 5 which entail the risk of interferences between the rocket R being launched and the cover.

A further embodiment of the protection device 8 according to the invention, not shown in the drawings given that it is generally known, provides for a permanent magnet brake for braking the rotation of the cover 5 in the two alignment positions between the openings 6 and the launch tubes 3A, 3B.

Figure 9:
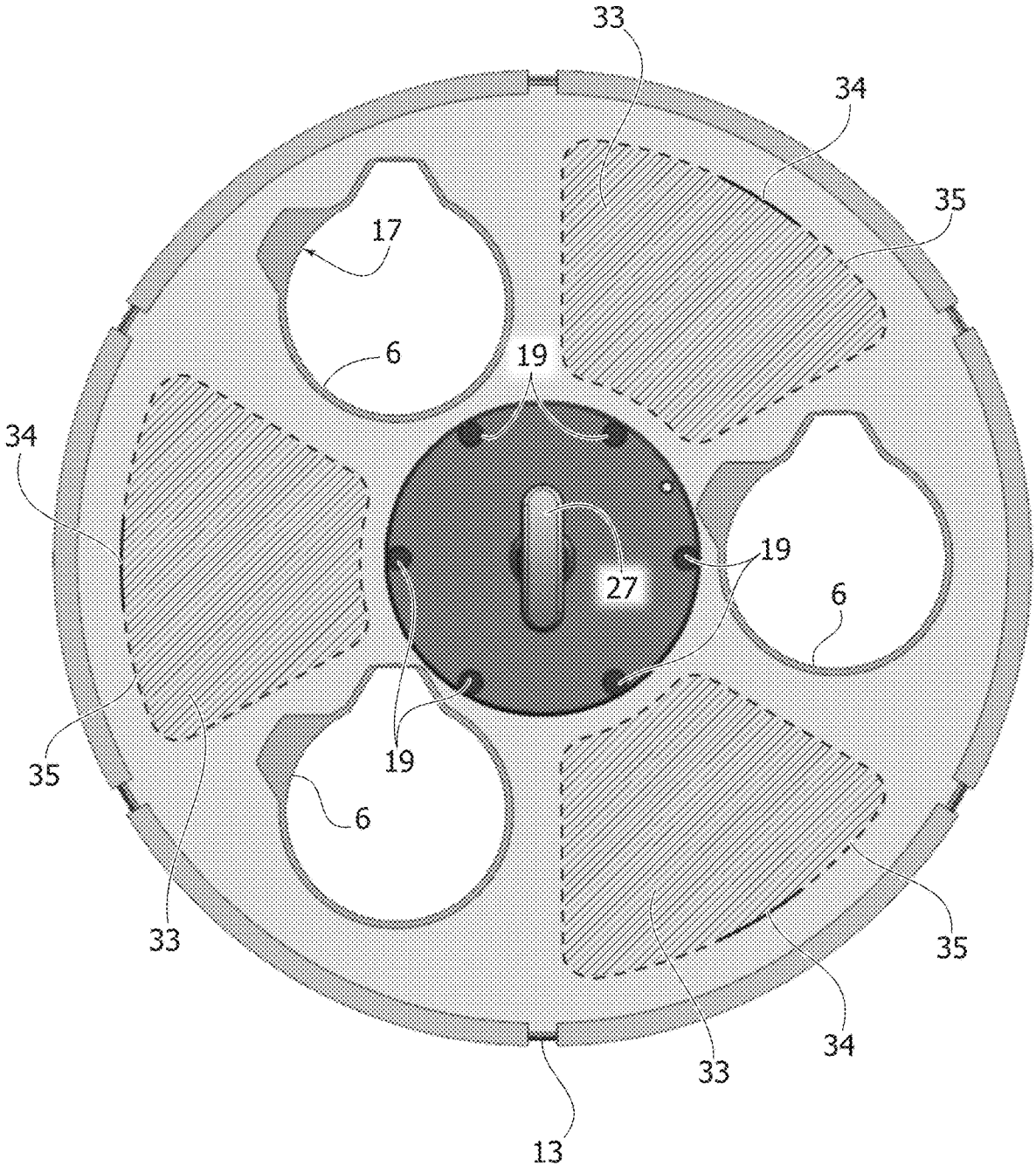
FIG. 9 is a schematic perspective view of an embodiment of the cover of the protection device according to the invention.

In the embodiment of the protection device shown in FIG. 9, the cover 5 comprises a triplet of safety portions 33 alternating with the openings 6 and designed to break without creating fragments should a rocket R not aligned with one of the openings 6 of the cover 5 be launched inadvertently. Such safety portions 33 are made of a composite material having a continuous epoxy matrix surrounded by a perimeter line comprising a part 35 in which the fibres are interrupted mechanically, and a part 34 in which the fibres are continuous. A such configuration of the epoxy matrix allows to create a weakening line 34, 35 for each safety portion 33, such that the breaking of the line 35 with the interrupted fibres entails the detachment of the safety portion 33 and a subsequent rotation thereof around the line with the continuous fibres 34 so as to remain connected to the cover.

Obviously, the construction details and the embodiments may widely vary with respect to what has been described and illustrated, without departing from the scope of protection of the present invention as defined in the claims that follow. Therefore, for example, the general shape of the cover 5 and the arrangement of the actuation means 8 thereof could be different from the ones shown in the drawings, and the rocket launching device 1 could be adapted to be installed both in fixed stations and on the land vehicles or fixed or rotary wing aircraft.

The invention claimed is:

1. Protection device for a tubular rocket launcher provided with a first and a second triplet, of rocket housings arranged in angularly equidistant positions with respect to an axis of the rocket launcher, the housings of the first triplet being alternated with the housings of the second triplet, said protection device comprising:

a circular cover applied in a coaxially rotatable fashion to the rocket launcher, the circular cover forming a front closure of a front end of said rocket launcher and an actuation means for rotating said cover, said cover comprising a triplet of openings arranged in angularly equidistant positions so as to allow the passage of rockets housed in one or the other of said first and second triplet of housings, and said cover comprises a triplet of safety portions, each provided with a weakening line arranged for breaking the corresponding safety portion without fragments, said safety portions being angularly interposed between said openings of the cover, and said actuation means designed to rotate the cover between a first position in which said triplet of openings is aligned with said first triplet of housings and a second position in which said triplet of openings is aligned with said second triplet of housings.

2. Protection device for a rocket launcher according to claim 1, said safety portions are made of a composite material having a continuous epoxy matrix surrounded by a perimeter line comprising a part in which fibres of the composite material are mechanically interrupted so to allow the breaking of the corresponding safety portion and a part in which the fibres are continuous so as to allow the broken safety portion to remain connected to the cover so as not to produce fragments.

3. Protection device for a rocket launcher according to claim 2, wherein said actuation means comprise an electronic control unit, an electric motor controlled by said control unit, a drive shaft of the cover, and a manual release device including releasable coupling means between said motor and said drive shaft.

4. Protection device for a rocket launcher according to claim 3, further comprising a safety device adapted to check the correct alignment of said triplet of openings with said first or said second triplet of housings of the rockets to be launched, said safety device including at least one movable presser tooth carried by said cover and at least a pair of fixed switches cooperating with said presser tooth.

5. Protection device for a rocket launcher according to claim 4, further comprising a mechanical limit switch designed to ensure the correct alignment of said triplet of openings with said first or said second triplet of housings of the rockets to be launched, said limit switch including at least one movable abutment element carried by said cover and at least a pair of fixed abutment elements cooperating with said movable abutment element.

6. Protection device for a rocket launcher according to claim 5, further comprising a permanent magnet brake controlled by said electronic control unit for braking the rotation of said cover in said first and second alignment position.

* * * * *